United States Patent [19]

Denlinger et al.

[11] Patent Number: 4,685,886

[45] Date of Patent: Aug. 11, 1987

[54] ELECTRICAL PLUG HEADER

[75] Inventors: Keith R. Denlinger, Lancaster; William J. Rudy, Jr., Annville; Daniel E. Stahl, Harrisburg, all of Pa.

[73] Assignee: AMP Incorporated, Harrisburg, Pa.

[21] Appl. No.: 879,715

[22] Filed: Jun. 27, 1986

[51] Int. Cl.[4] ..... H01R 13/11; H01R 13/642

[52] U.S. Cl. ..... 439/55; 439/374; 439/856

[58] Field of Search ..... 339/64 R, 64 M, 65, 339/66 R, 66 M, 176 M, 176 MP, 256 SP, 258 F, 258 S, 74 R, 17 LC, 258 R

[56] References Cited

U.S. PATENT DOCUMENTS

| | | | |
|---|---|---|---|
| 1,538,197 | 5/1925 | McClatchie | 339/66 R |
| 2,853,689 | 9/1958 | Jackson et al. | 339/176 MP |
| 3,149,899 | 9/1964 | Johanson | 339/176 MP |
| 3,400,360 | 9/1968 | Schmitt et al. | 339/64 R |
| 4,193,660 | 3/1980 | Jaconette | 339/258 R |
| 4,390,224 | 6/1983 | Showman et al. | 339/17 LC |
| 4,397,511 | 8/1983 | Clark et al. | 339/17 LC |
| 4,458,971 | 7/1984 | D'Urso et al. | 339/217 S |
| 4,514,030 | 4/1985 | Triner et al. | 339/176 MP |
| 4,553,808 | 11/1985 | Weidler et al. | 339/97 R |
| 4,618,199 | 10/1986 | Pfaff | 339/74 R |

FOREIGN PATENT DOCUMENTS

| | | | |
|---|---|---|---|
| 1209187 | 10/1970 | United Kingdom | 339/258 R |

*Primary Examiner*—Eugene F. Desmond
*Assistant Examiner*—Gary F. Paumen
*Attorney, Agent, or Firm*—Anton P. Ness

[57] ABSTRACT

A plug header includes a plurality of tab receptacle contact terminals in two rows of passageways to receive blade sections of male terminals of a mating connector thereinto without stubbing. Lead-in surfaces at forward ends of the passageways cooperate with coplanar tapered forward portions of the opposing spring contact arms to provide continuous lead-in means. One of the spring contact arms is a dual beam for two points of contact engagement with the blade terminal. An axial rib segment of the adjacent passageway wall juts into the slot between the diverging front portions of the dual beam and has a tapered lead-in surface coplanar with the forward surfaces of the diverging front portions. And the slot has stop surfaces engageable with the rib segment if the dual beam spring contact arm is substantially stressed outwardly to minimize overstressing thereof.

8 Claims, 8 Drawing Figures

14
16
18
12
22a
24
10
30A
30B
28A
20B
28A
20A
26B
26A
40
50

ELECTRICAL PLUG HEADER

FIELD OF THE INVENTION

This relates to the field of electrical connectors and more particularly the field of connectors having receptacle contact terminals.

BACKGROUND OF THE INVENTION

Plug headers are known which utilize tab receptacle contact terminals for mating with receptacle connectors having blade-like male terminals within a large receptacle cavity. Such plug headers are used for instance in control units for automobiles utilizing microprocessor chips to control various powered functions within the automobile such as high speed fans and power windows and so on, at a typical current level of 15 amperes. Such a header is mounted on the control unit to matingly receive the receptacle connector of the cable harness, and its contact terminals are electrically connected to circuits of a printed circuit board. The receptacle contact sections of the terminals are disposed in respective passageways proximate the mating face of the housing to receive blade-like contact sections of the male terminals, and each receptacle contact section consists of a pair of opposed wide double-back cantilever spring arms having formed lead-ins to assist aligning the blade, and which electrically engage both sides of the blade upon full insertion. However, the blades in the receptacle cavity of the receptacle connector are commonly not well aligned and occasionally may require a more significant alighment mechanism than is provided by the lead-in of the known mating connector, and the known lead-in system can result in stubbing and damage to one or both of the mating terminals, requiring their replacement. Also, with opposing wide spring arms it is common for at least one of the arms to engage the blade firmly at only one location across the blade, with the remainder of the arm angled slightly away from the blade, and this may lead to overheating of the mated contacts and consequent damage and failure.

An improved tab receptacle contact terminal is known from U.S. Pat. No. 4,458,971 assigned to the asignee hereof, which discloses a dual beam spring contact arm opposing a single wide beam spring contact arm, with diverging forward sections of the dual beam and wide beam contact arms. However, the housing has terminal passageways with narrow openings, which have lead-in surfaces at the mating face which perform essentially all of the aligning of the blade of the mating terminal. The diverging forward sections of the contact arms are disposed behind the passageway lead-ins and are protected thereby from engagement with the inserted blade.

It is desirable to provide a receptacle contact which assures electrical engagement under sufficient normal force with a blade at at least two laterally spaced locations, and which reduces the tendency to overheat at 15 to 20 amperes current, while being resilient and capable of being formed by stamping and forming.

It is further desirable to provide an improved anti-stubbing capability in a connector having receptacle terminals.

It is even further desirable to improve the resistance to stress on the receptacle contact arms.

SUMMARY OF THE INVENTION

The present invention provides a tab receptacle terminal for a plug header wherein the receptacle contact section comprises a dual beam spring contact arm opposed from a wide single beam spring contact arm. At the front end of the contact section the dual beam and single beam arms diverge from the constriction comprising the area of engagement with the mating tab or blade which constriction is formed by relatively distinct bends extending laterally across the dual beam and single beam contact arms. Terminal-receiving passageways of the housing extend rearwardly from the mating face thereof and have tapered lead-in surface portions to assist receipt of the blades of the mating connector by substantially aligning them prior to engagement by the contact arms of the corresponding tab receptable terminals. The diverging front ends of the tab receptacle terminals are so positioned axially in the passageway and possess an angle of taper so selected as to virtually continue the passageway lead-ins and thus continue the alignment of the blades during mating minimizing potential stubbing.

According to a further aspect of the invention, the slot between the two beams of the dual beam arms allows independent spring action of the two beams and is widened between the diverging front ends of the beams forward of their lateral bends. An axial rib segment of the housing extends forwardly from an otherwise shortened passageway sidewall adjacent the dual beam arm, and end portions of the two beams extend outwardly beside the rib segment so that the rib segment is disposed within the widened slot portion between the ends of the two beams. The forwardly facing surface of the rib segment is tapaered to the lead-in surface at the front end of the passageway on the sidewall adjacent the dual beam spring arm, further serving to minimize potential stubbing during blade insertion. The end of the widened portion of the slot is engageable with the rib segment if the inserted blade urges the dual beam spring contact arm far enough outwardly towards the adjacent passageway sidewall and the rib segment would then support each of the two beams minimizing a tendency to overstress the dual beam contact arm after mating. The slot may coincide with the seam of the stamped and formed tab receptacle terminal.

According to still a further aspect of the invention, the tab receptacle terminals are loaded into the housing from the mating face, with the board-engaging ends inserted through the housing to extend beyond the rear face. The board-engaging ends are then bent around anvils of the housing to extend downwardly at 90° from axial, for insertion of board engaging contact sections into plated through holes of a printed circuit board. When the terminals are bent around the anvils, the terminals are pulled firmly into the passageways such that rear stop surfaces of the tab receptacle contact sections engage forwardly facing stop surfaces of the pasageways, which serves to precisely position the receptacle contact sections axially along the passageways and thus precisely position the diverging forward sections of the spring contact arms with respect to the lead-in surface portions of the housing passageways.

It is an objective of the present invention to provide a connector having the receptacle terminals for mating with a mating connector having blade terminals, which connector is adapted to properly align even greatly misaligned blade terminals of the mating connector without stubbing.

It is a further objective of the present invention to provide a connector which has better current-carrying capability for longer in-service life or the ability to carry higher current levels than known connectors, or both.

DETAILED DESCRIPTION OF THE PREFERRED EMBODIMENT

Figure 1:
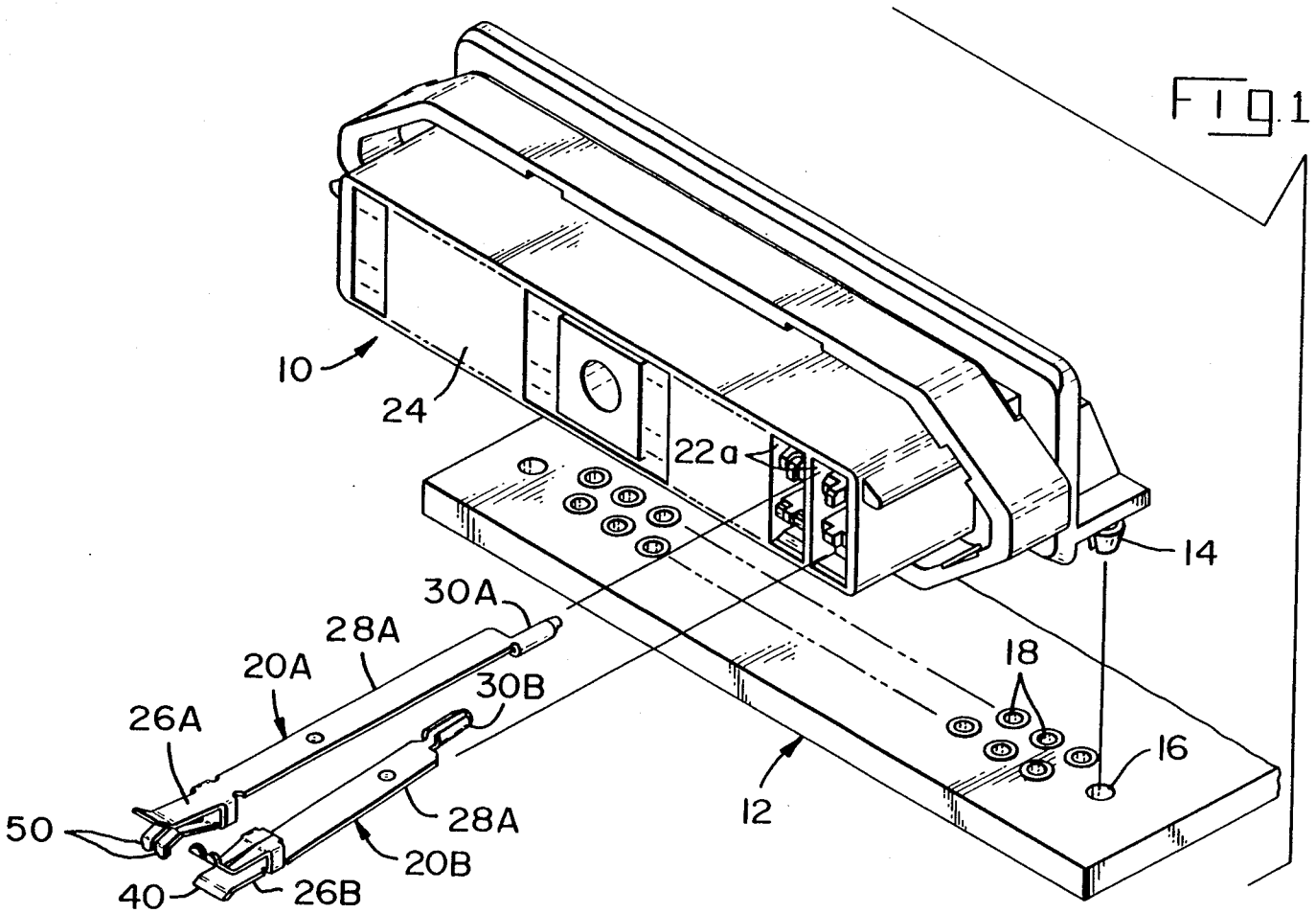
FIG. 1 is a perspective view showing a header and tab receptacle terminals for insertion thereinto, comprising the present invention.

In FIG. 1 plug header 10 is mountable to a printed circuit board 12 by mounting pins 14 snappably insertable into and through holes 16. Board 12 has an array of plated through-holes 18 (which could be discrete sockets) to receive resilient contact end sections of terminals of header 10. Upper terminals 20A and lower terminals 20B are securable in respective pasageways 22A,22B of header 10 by being inserted thereinto from mating face 24. Terminals 20A,20B have tab receptacle contact sections 26A,26B at forward ends of long flat body sections 28A,28B, and resilient C-shaped board contact sections 30A,30B at rearward ends thereof.

Figure 2A:
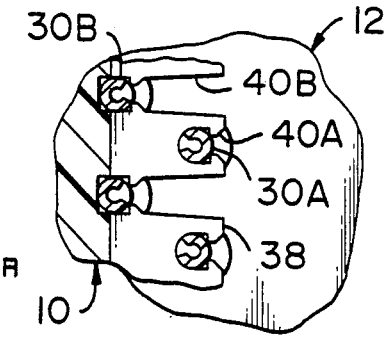
FIG. 2A is a part plan view showing the board contact sections of several terminals in the retention plate and connected to the board.
Figure 2:
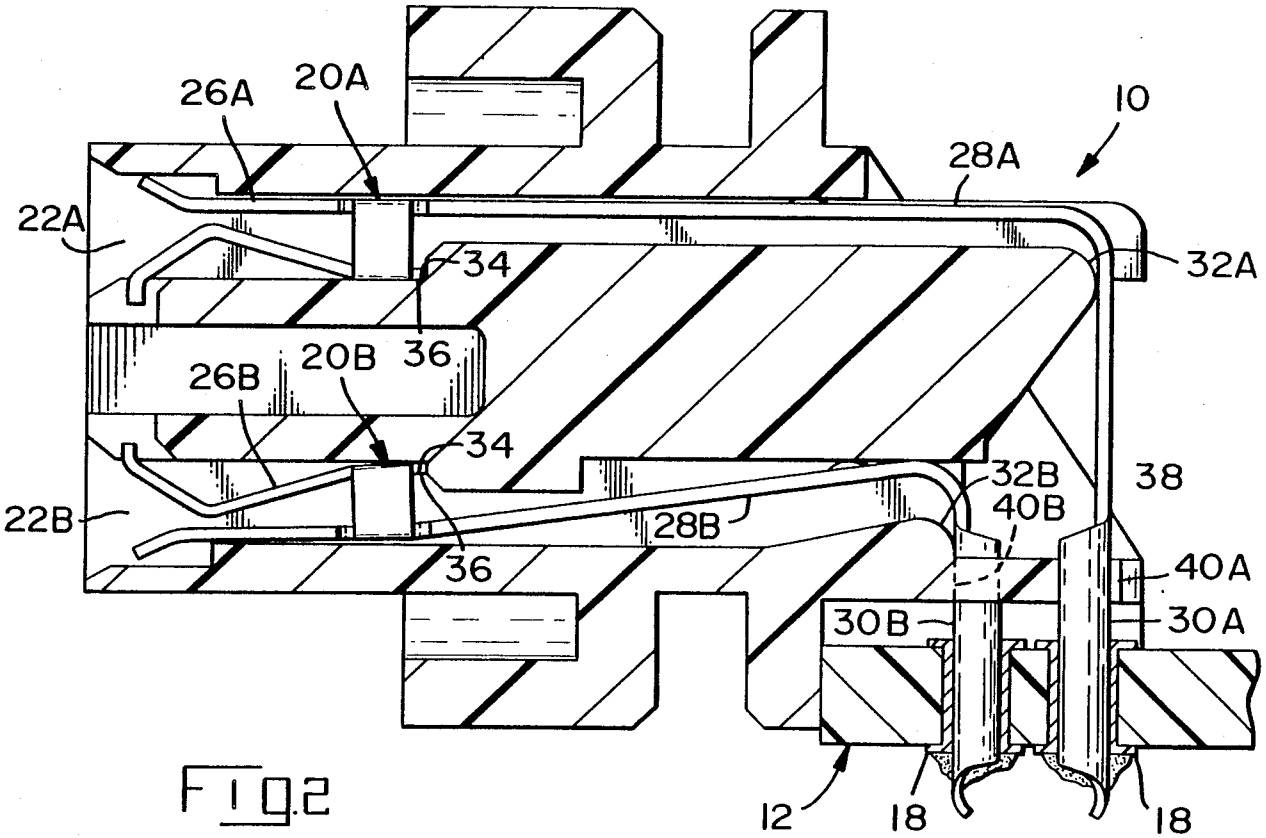
FIG. 2 is a longitudinal section view taken along lines 2—2 of FIG. 1 which shows terminals after being secured in the header, bent around the anvils and also secured to a printed circuit board.

With reference to FIG. 2, terminals 20A,20B are inserted into respective passageways 22A,22B so that contact sections 30A,30B extend beyond radiussed anvils 32A,32B formed on the board-proximate sides of passageways 22A,22B of header 10. Body sections 28A,28B are then bent around anvils 32A,32B to extend at right angles to the passageways. A positive stop 34 is formed at the rear of each receptacle contact section which engages a forwardly facing stop surface 36 along the passageway, which locates the receptacle contact section during loading. It can be seen that body section 28B is long enough that when it is bent over corresponding anvil 32B, C-shaped board contact section 30B extends below retention plate 38 in a forward row. Longer body section 28A is bent over corresponding anvil 32A spaced rearwardly from (and above) anvil 32B so that C-shaped board contact section 30A extends below retention plate 38 in a rearward row. Best illustrated in FIG. 2A, C-shaped contact sections 30A,30B move laterally into slots 40A,40B of retention plate 38 during loading which slots having means to retain them in position to be inserted into plated through-holes 18 of board 12, after which contact sections 30A, 30B are preferably soldered in plated through-holes 18. Insertion of contact sections 30A,30B into holes 18 results in urging the rearward ends of body sections 28A,28B upward against the top walls of respective passageways 22A,22B.

Figure 1A:
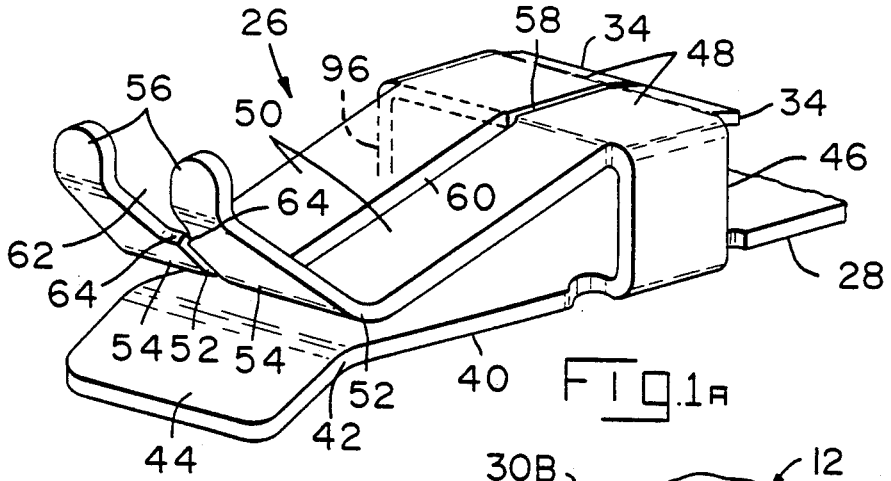
FIG. 1A is an enlarged perspective view of the tab receptacle section of a terminal of FIG. 1.

Tab receptacle contact sections 26A,26B are structured identically and their sections will be numbered without distinction between contact terminals 20A,20B. In FIG. 1A a wide single beam spring contact arm 40 of contact section 26 extends integrally forwardly from each body section 28 and is bent at bend 42 to have an outwardly tapered end portion 44 forwardly thereof. Upstanding wall portions 46 proximate body sections 28, and inwardly directed top portions 48 define a box-like shape. Extending slightly rearwardly from top portions 48 are tabs which include stops 34. Extending forwardly from top portions 48 are respective parallel spring arms 50 which define respective beams of a "dual beam" spring contact arm opposed from single beam contact arm 40. Spring arms 50 first converge toward contact arm 40 to respective bends 52 just rearwardly of bend 42 of contact arm 40 to form a constriction which will provide the electrical engagement with a blade of a mating terminal inserted thereinto. Spring arms 50 have front portions 54 which will diverge from contact arm 40 and conclude with end portions 56 which extend outwardly in an axially normal direction. Top portions 48 abut or almost meet along seam 58 and forwardly thereof spring arms 50 are spaced apart by a clearance 60. Forwardly of bends 52 a wider slot 62 extends from clearance 60 to end portions 56 with stops 64 defining the inner end of wider slot 62 for a purpose to be described below.

In FIG. 2, receptacle contact section 26A of terminal 20A has its single beam spring contact arm 40 along the relatively outer sidewall 66 of passageway 22A and its two opposing spring contact arms 50 along relatively inner sidewall 68 of passageway 22A. Body section 28A is also disposed along outer sidewall 66 and a dimpled boss 70 spaces body section 28A slightly therefrom. Terminal 20B can be stamped and formed identically to terminal 20A except that body section 28B is much shorter, and terminal 20B is inserted "upside down" into its passageway 22B causing its single beam spring contact arm 40 to be along outer sidewall 72 of passageway 22B and spring contact arms 50 along inner sidewall 74 thereof, opposite from terminal 20A in passageway 22A. However, body section 28B at bend 76B proximate anvil 32B is urged upward against inner sidewall 74 by the process of mounting header 10 to board 12, but this is believed not to affect receptacle contact section 26B because stress is localized rearwardly of upstanding wall portions 46.

Figure 3:
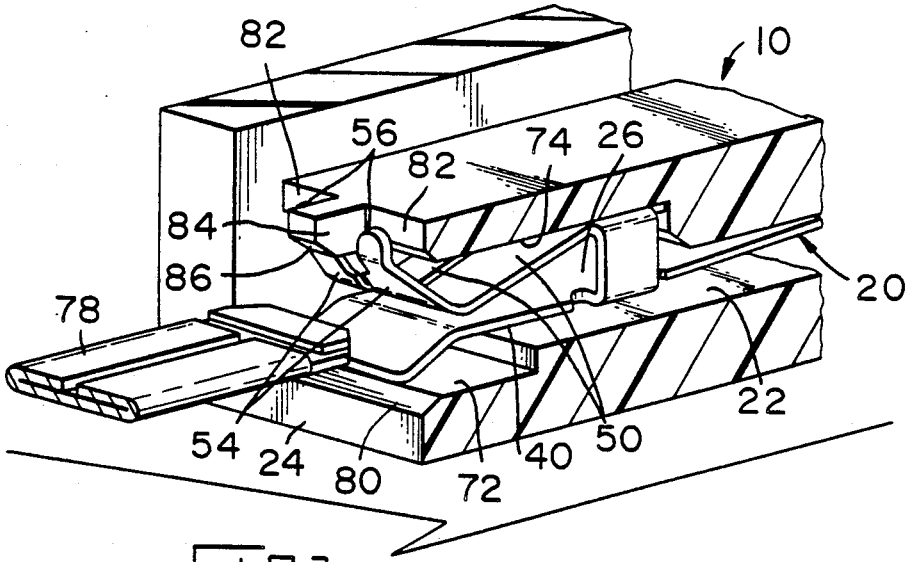
FIG. 3 is an enlarged part section view illustrating a mating blade terminal about to be inserted into the tab receptacle terminal of the invention, secured in the header.

In FIG. 3, a representative receptacle contact section 26 is disposed within a forward portion of a representative passageway 22, and a representative blade contact section 78 of a mating connector is situated for insertion thereinto. Blade 78 happens to be shown approximately aligned, but the receptacle contact section and the passageway of the present invention are designed to overcome problems with misaligned blades. Outer sidwall 72 has a tapered lead-in surface 80 at the front end extending inwardly from mating face 24. Tapered end portion 44 of arm 40 is designed to continue the lead-in of surface 80 by being approximately coplanar therewith and having about the same angle, so that a misaligned blade 78 being urged into alignment by surface 80 will continue being aligned by end portion 44 without stubbing.

Vertical end portions 56 at front ends of spring contact arms 50 extend into recesses 82 in inner sidewall 74 of passageway 22, but are intentionally spaced from any engagement therewith upon loading into header 10 to permit flexing of spring contact arms 50. An axial rib segment 84 extends forwardly from recesses 82 to mating face 24 and is disposed in the slot 62 between end portions 56. Rib segment 84 has a tapered lead-in surface 86 extending to mating face 24. Tapered front ends 54 of spring arms 50 are designed to continue the lead-in surface 86 by being approximately coplanar therewith and having about the same angle, so that a misaligned blade 78 being urged into alignment by surface 86 will continue being aligned by front ends 54 without stubbing.

Figure 4A:
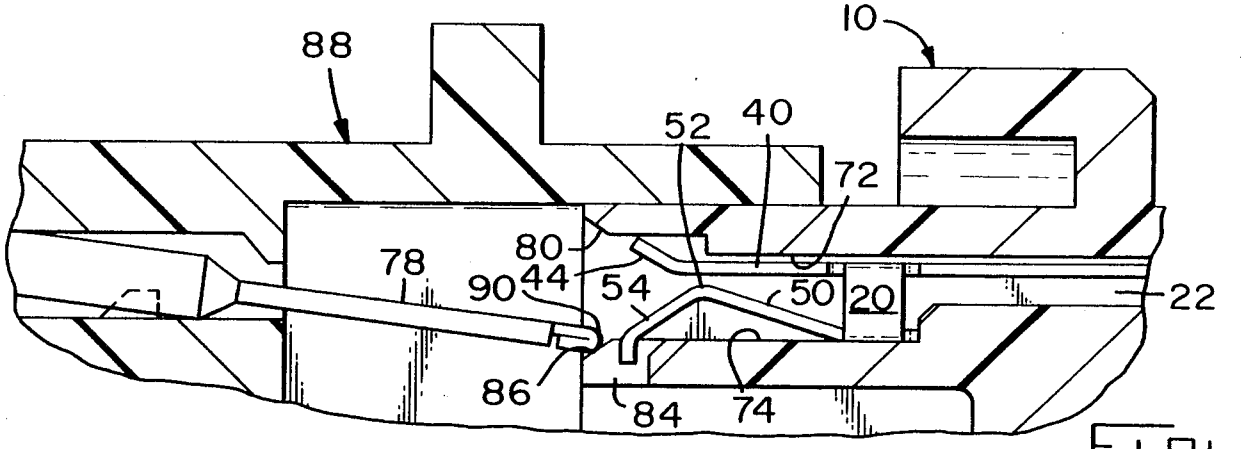
FIGS. 4A, 4B and 5 are a sequence of longitudinal section views illustrating a mating connector having a misaligned blade terminal during mating mated with the header of the invention.
Figure 4B:
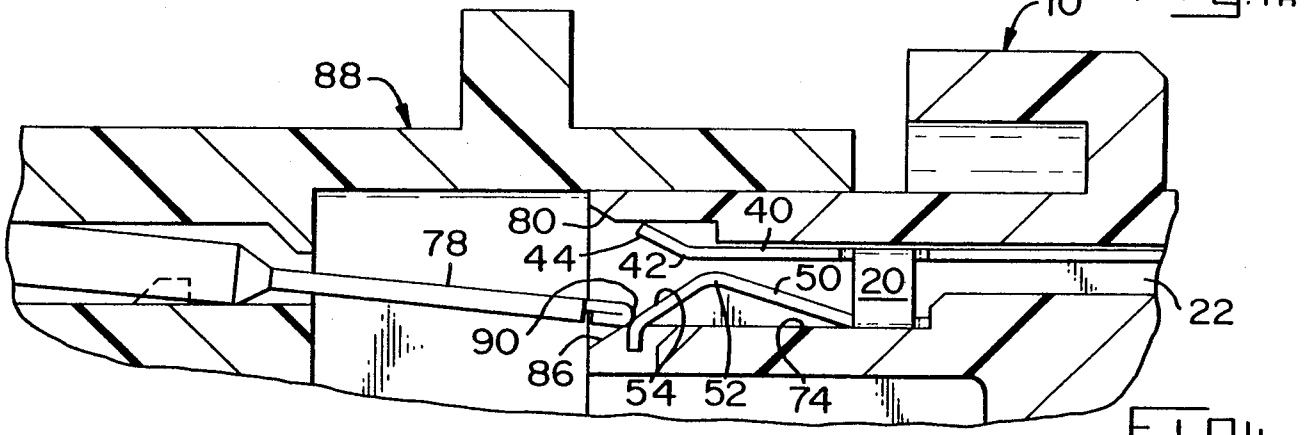
Figure 5:
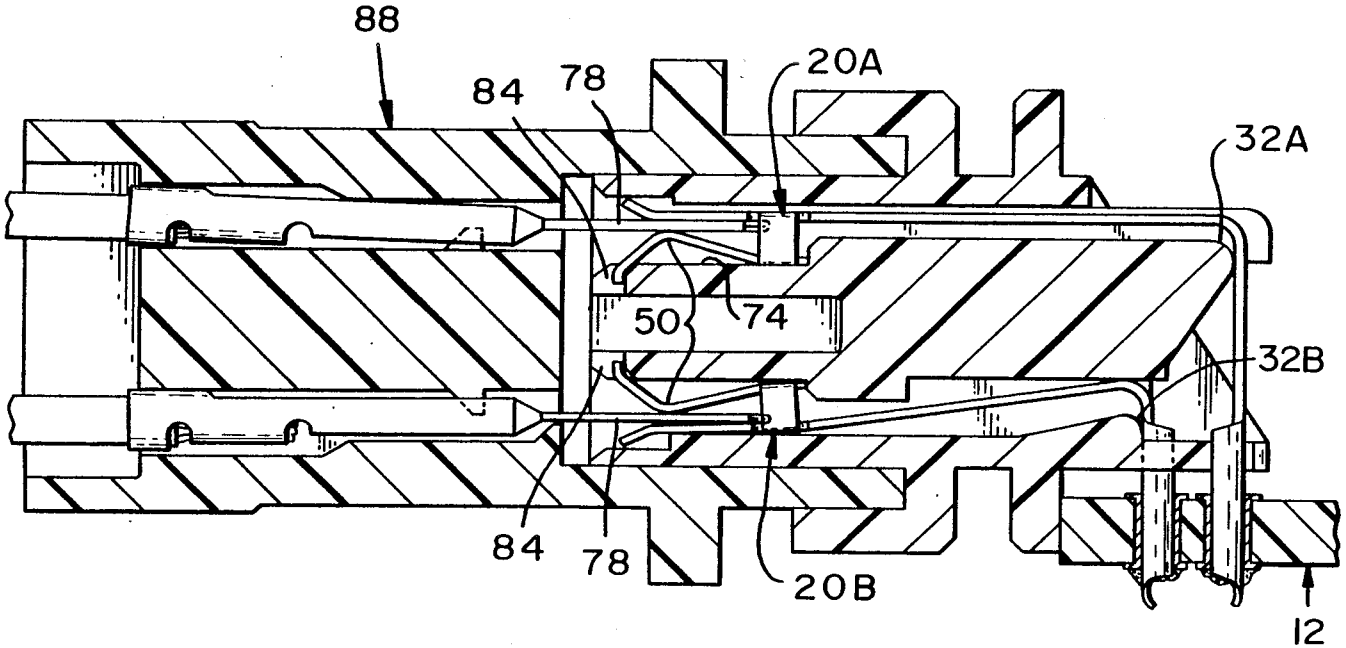

FIGS. 4A, 4B and 5 illustrate the mating sequence of a blade 78 of a connector 88 which is misaligned. Tip 90 of blade 78 first engages surface 86, then engages a terminal 20 at tapered front ends 54 of spring arms 50, and then when aligned enters the constriction between bends 42 and 52. In FIG. 5, as spring arms 50 are urged outwardly toward inner sidewall 74 by blade 78, the possibility of overstressing of arms 50 is minimized by stops 64 engaging against rib segment 84. Spring arms 50 acting independently of each other will electrically engage blade 78 at at least two laterally spaced locations thereacross and thereby result in lower heat generation than would result from only one point of contact.

It is preferred to stamp and form terminals 20A,20B from Copper Alloy 17410 which is believed capable of current carrying about 45% that which is carried by pure copper, as distinct from the 15% current carrying capability of conventional beryllium copper such as Copper Alloy 17500 typically used for high resilience stamped and formed receptacle terminals. It is preferred that tapered end portion 44 of single beam spring contact arm 40 of each terminal 20A,20B be biased against its outer sidewall 66,72 upon loading in header 10 to asure its anti-stubbing benefits. It is also preferred that anvils 32A,32B be somewhat gently rounded rather than sharply radiussed to facilitate bending of terminal body sections 28A,28B thereover.

Other variations may occur to the plug header of the present invention and its terminals without departing from the spirit of the invention and the scope of the claims.

What is claimed is:

1. An electrical connector assembly for mating with a mating connector, said mating connector including an array of male terminals having blade-liked contact sections extending forwardly from a mating face thereof, said assembly comprising housing means having a plurality of passageways extending therethrough from a mating face to a rear face thereof, and a like plurality of contact terminals secured in corresponding ones of said passageways and including tab receptacle contact sections at forward ends thereof disposed proximate said mating face to receive corresponding ones of said blade-like contact sections of said male terminals thereinto, said assembly characterized in that:

each of said tab receptable contact sections comprises a single beam spring contact arm opposed by a dual beam spring contact arm, said dual beam contact arm comprises two cantilever beams spaced apart by a slot of selected width and extending forwardly from a box-like section of said tab receptacle terminal, each said cantilever beam having a first portion extending forwardly from said box-like section and converging toward said opposing single beam contact arm and a front portion diverging from said opposing single beam contact arm, at least said front portions of said two cantilever beams being substantially spaced apart defining a forward portion of said slot;

the forward end of a first wall of each said housing passageway is proximate an associated said dual beam spring contact arm and concludes in a centrally disposed axial rib segment extending to said mating face of said housing and having a first tapered surface defining lead-in means for facilitating receipt of a corresponding said blade-like contact section of a said male terminal, said rib segment being situated in said forward portion of said slot between said front portions of said two cantilever beams; and blade-proximate surfaces of said diverging front portions of said two cantilever beams being substantially coplanar with said first tapered surface of said rib segment, whereby a substantially continuous first lead-in means is provided by said first tapered surface and said diverging front portions which is especially adapted to receive thereinto a misaligned blade-like contact section of a said male terminal without stubbing.

2. An electrical connector assembly as set forth in claim 1, further characterized in that said forward portion of said slot includes stop surfaces therealong facing outwardly and forwardly and which are adapted to stoppingly engage said rib segment upon said dual beam spring contact arm being urged laterally outwardly by a said blade-like contact section of a said male terminal upon mating, to minimize overstress on said dual beam spring contact arm.

3. An electrical connector assmebly as set forth in claim 1, further characterized in that the forward end of a second wall of each said housing passageway is proximate an associated said single beam spring contact arm and concludes in a second tapered surface extending to said mating face of said housing defining lead-in means for a corresponding said blade-like contact section of a said male terminal, and said single beam spring contact arm includes a tapered end portion substantially coplanar with said second tapered surface of said second wall, whereby a substantially continuous second lead-in means is provided by said second tapered surface and said tapered end portion to receive thereinto a misaligned blade-like contact section of a said male terminal without stubbing.

4. An electrical connector assembly as set forth in claim 3 further characterized in that the forward end of said single beam spring contact arm is pre-loaded against said second passageway wall.

5. An electrical connector assembly as set forth in claim 1 further characterized in that said contact terminals include rearwardly facing stop means, said passageways include forwardly facing stop surfaces, and said contact terminals are inserted into respective said passageways from said mating face with said stop means and said stop surfaces in cooperation positioning said contact terminals axially along said passageways to align at least said first tapered surface of said first passageway wall and said diverging front portions of said dual beam spring contact arm.

6. An electrical connector assembly as set forth in claim 5 further characterized in that said housing means is a plug header, said contact terminals include flat body sections rearwardly from said tab receptacle contact sections and board connecting contact sections on rearward ends thereof, said housing passageways are arranged in at least a lower row and an upper row, and said body sections of said contact terminals are bend over anvils of said plug header at approximately right angles, with said board connecting contact sections thereof being electrically connectable to contact means of circuit means of a printed circuit board, and whereby said contact terminals are secured in said passageways against relatively forward axial movement.

7. An electrical connector assembly as set forth in claim 1 wherein said contact terminals are stamped and formed and said slot is disposed along a seam of said tab receptacle contact section.

8. An electrical connector assembly for mating with a mating connector, said mating connector including an array of male terminals having blade-like contact sections extending forwardly from a mating face thereof, said assembly comprising housing means having a plurality of passageways extending therethrough from a mating face to a rear face thereof, and a like plurality of contact terminals secured in corresponding ones of said passageways and including tab receptacle contact sections at forward ends thereof disposed proximate said mating face to receive corresponding ones of said blade-like contact sections of said male terminals thereinto, said assembly characterized in that:

each of said tab receptacle contact sections comprises a single beam spring contact arm opposed by a dual beam spring contact arm, said dual beam contact arm comprises two cantilever beams spaced apart by a slot of selected width and extending forwardly from a box-like section of said tab receptacle terminal, each said cantilever beam having a first portion extending forwardly from said box-like section and converging toward said opposing single beam contact arm and a front portion diverging from said opposing single beam contact arm, said front portions of said two cantilever beams being substantially spaced apart defining a widened forward portion of said slot;

a forward end of a first wall of each said housing passageway is proximate an associated said dual beam spring contact arm and concludes in a centrally disposed axial rib segment extending to said mating face of said housing and having a first tapered surface defining initial lead-in means for facilitating receipt of a corresponding said blade-like contact section of a said male terminal, said rib segment being situated in said widened forward portion of said slot between said front portions of said two cantilever beams;

blade proximate surfaces of said diverging front portions of said two cantilever beams being substantially coplanar with said first tapered surface of said rib segment, defining a substantially continuous first lead-in means to receive therealong a blade-like contact section of a said male terminal, and the rearward end of said widened forward portion of said slot defines stop surfaces therealong facing outwardly and forwardly and which are adapted to stoppingly engage said rib segment upon said dual beam spring contact arm being urged laterally outwardly by a said blade-like contact section of a said male terminal upon mating; and a forward end of a second wall of each said housing passageway is proximate an associated said single beam spring contact arm and concludes in a second tapered surface extending to said mating face of said housing defining initial lead-in means for facilitating receipt of a corresponding said blade-like contact section of a said male terminal, and said single beam spring contact arm includes a tapered end portion substantially coplanar with said second tapered surface of said second wall, defining a substantially continuous second lead-in means to receive therealong said blade-like contact section of a said male terminal, whereby each said tab receptacle contact terminal and associated housing passageway have substantially continuous first and second lead-in means which are cooperable with each other and whereby a connector is provided which is especially adapted to assuredly mate with a said mating connector having possibly respectively misaligned blade-like contact sections of male terminals without stubbing.

* * * * *